US009145663B1

(12) United States Patent
Hoeptner

(10) Patent No.: US 9,145,663 B1
(45) **Date of Patent: *Sep. 29, 2015**

(54) TUBULAR PLASTIC HYDRANT

(71) Applicant: Herbert W. Hoeptner, Gilroy, CA (US)

(72) Inventor: Herbert W. Hoeptner, Gilroy, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/120,053

(22) Filed: Apr. 21, 2014

Related U.S. Application Data

(63) Continuation-in-part of application No. 13/506,535, filed on Apr. 26, 2012, now Pat. No. 8,739,810.

(51) Int. Cl.

| | |
|---|---|
| ***E03B 7/10*** | (2006.01) |
| ***E03B 7/12*** | (2006.01) |
| ***E03B 9/02*** | (2006.01) |
| ***E03B 9/04*** | (2006.01) |

(52) U.S. Cl.
CPC ..... *E03B 9/04* (2013.01); *Y10T 137/5327* (2015.04); *Y10T 137/5392* (2015.04)

(58) Field of Classification Search
CPC ..... E03B 9/04
USPC ..... 137/360, 301, 302, 59, 60, 61
See application file for complete search history.

(56) References Cited

U.S. PATENT DOCUMENTS

| | | | |
|---|---|---|---|
| 5,029,603 | A | 7/1991 | Ackroyd |
| 5,590,679 | A | 1/1997 | Almasy et al. |
| 5,752,542 | A | 5/1998 | Hoeptner, III |
| 6,769,446 | B1 | 8/2004 | Ball et al. |
| 6,805,154 | B1 | 10/2004 | Dickey et al. |
| 6,830,063 | B1 | 12/2004 | Ball |
| 6,883,534 | B2 | 4/2005 | Ball et al. |
| 2010/0229961 | A1 | 9/2010 | Ball et al. |

*Primary Examiner* — Craig Schneider
*Assistant Examiner* — Kevin Barss
(74) *Attorney, Agent, or Firm* — William W. Haefliger

(57) ABSTRACT

In a hydrant assembly, the combination comprising an outer tubular member having a first flow port; an inner tubular member having a closure thereon to close the port in relative axially advanced position of the closure, and to open the port in relative axially retracted position of the closure that allows fluid flow through the port to an outlet, control means to control relative movement of the inner and outer members. The closure means may include a bullet, an O-ring or the like carried by said bullet, the bullet telescopically carried by said inner member. A bore carried by the outer tubular member is in sliding sealing relationship to said O-ring. Once hydrant is closed (off position) the bullet will continue to advance into the bore as pressure in the outer tubular member increases when residual water freezes. Because of advancement of the bullet, pressure in the outer tubular member will never exceed supply line pressure thus preventing damage to the outer tubular member. A second port may be located sidewardly of the outer tubular member to pass fluid in relatively advanced position of the closure to relieve fluid pressure in space formed between the inner and outer members, the inner member being elongated and extending lengthwise in the outer tubular member. Since the pressure in the outer tubular member never exceeds the supply pressure, the outer tubular member can be made of plastic to reduce costs.

11 Claims, 2 Drawing Sheets

TUBULAR PLASTIC HYDRANT

This application is a continuation-in-part of Ser. No. 13/506,535, filed Apr. 26, 2012.

BACKGROUND OF THE INVENTION

A freezeless wall hydrant is used to deliver water to the outside of a building. It consists of a fluid closure valve within a pipe located inside the outer wall of a building. The pipe extends through the wall, terminating with hose threads outside the outer wall. Attached to the fluid closure valve is an elongated operating rod that terminates with a handle outside the pipe. Operation of the handle outside the wall opens and closes the fluid closure valve inside the wall. The freezeless wall hydrant is installed at an angle so when the hydrant is off, the water in the pipe will drain outside the outer wall, preventing the water from freezing and damaging the pipe.

A problem occurs when a hose is left on the hydrant whose outlet is higher than the hydrant, or a valve is added to the end of the hose, preventing water from draining from the hydrant. Water trapped in the hydrant will freeze when temperatures drop below 32 degrees Fahrenheit. As the water freezes, it expands. The hydraulic action of the freezing water expanding increases pressure on the liquid portion of the water remaining in the hydrant pipe between the expanding ice and the closed fluid closure valve inside the pipe, causing the pipe to rupture. Once the weather warms in the spring and the hydrant is turned on, costly flooding of the building typically will occur. U.S. Pat. No. 6,142,172, referenced herein, concerns relieving this pressure by employing a simple pressure relief valve, made up of a ball and spring within the fluid closure valve that would relieve build-up pressure from the hydrant pipe back into the supply line. One problem with this method is that possible contaminated water, leached from the hose, can be forced back into the supply line to be distributed to drinking water sources throughout the building. Back flow and cross contamination are major concerns for all code officials regarding water quality. In addition, to ensure contaminated water is not forced back into the supply every time there is a differential pressure across the fluid closure valve, that pressure relief valve must be set to a very high relief pressure adding undue stress to the hydrant piping system. As the pressure relief valve ages and corrodes it is likely that it will no longer relieve the pressure in the pipes which could exceed the limits of the pipe and to burst the pipe.

Conventional fluid closure means incorporates a rubber washer compressed on a seat for closure. The rubber washer is attached to an inner member that reciprocates in the flow passage to open and close the valve. Subsequent conventional designs have employed the same rubber washer closure means attached to a telescoping "bullet" that would telescope out to the seat when the valve was in the open position to prevent back flow and backpressure. When the valve was in the closed position no movement of the bullet was possible as it was trapped between the operating rod and the seat.

SUMMARY OF THE INVENTION

It is a major object of the invention to provide an improved, simple, highly effective valve assembly, that if not allowed to drain properly, will not burst when the water in the hydrant freezes.

Basically the assembly includes:

a) an outer tubular member having a first flow port, b) an inner member having closure means thereon to close said port in relatively axially advanced position of said closure means, and to open the port in relatively axially retracted position of said closure means, c) control means to control relative movement of the inner and outer members, d) a second port located sidewardly of said outer tubular member to pass fluid from space between said members to relieve fluid pressure buildup under freeze conditions, e) closure means defining an annular seal extending about an axis defined by said closure means, there being an axially elongated bore defined by the outer member, and into which said seal has sliding sealing fit as the closure is advanced; a hollow valve body carrying said members; and an adjustment handle carried by the body to adjust the inner member between relatively advanced and retracted positions, the handle limiting advanced position of the annular seal, the inner member positioned to carry the annular seal in telescoping relation such that the seal will continue to advance after closure is fully advanced by handle limit.

Added objects include provision of the closure means to continue to advance after the closure means is fully advanced by the handle to relieve pressure in said outer member from expanding ice formation when residual water freezes resulting from a hose and discharge nozzle or the like being attached. Once closure is fully advanced by the handle, pressure can be relieved by continued advancement of the closure member, or partial advance of the closure member, which opens said second port.

Another object includes provision for redundant or multiple redundant relieving of excess pressure, as during freezing conditions.

Another object of this invention is to provide a wall hydrant which has the ability to drain at least some of the residual water when under freezing conditions, residual water freezing because of a hose or the like being attached to the discharge nozzle.

It is a further object to provide a relief valve for the captured residual water to escape back towards the supply of pressurized water when the frozen water in the outer member of the hydrant creates excessive pressure on the remainder of the residual water in the hydrant.

These and other objects and advantages of the invention, as well as the details of an illustrative embodiment, will be more fully understood from the following specifications and drawings, in which:

DRAWING DESCRIPTION

DETAILED DESCRIPTION

Figure 1:
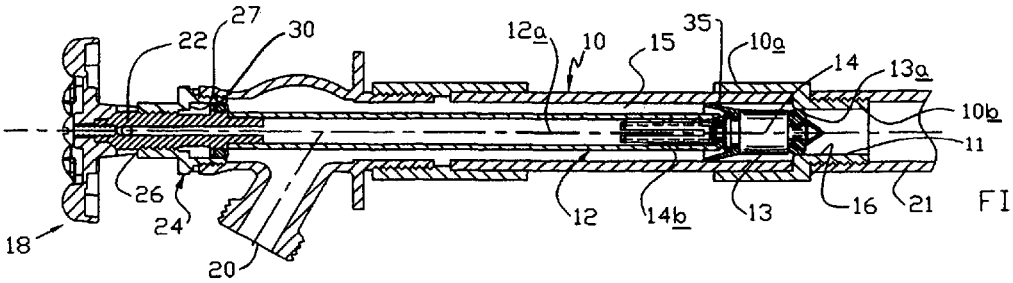
FIG. 1 shows hydrant structure in flow "OFF" or blocking position.
Figure 2:
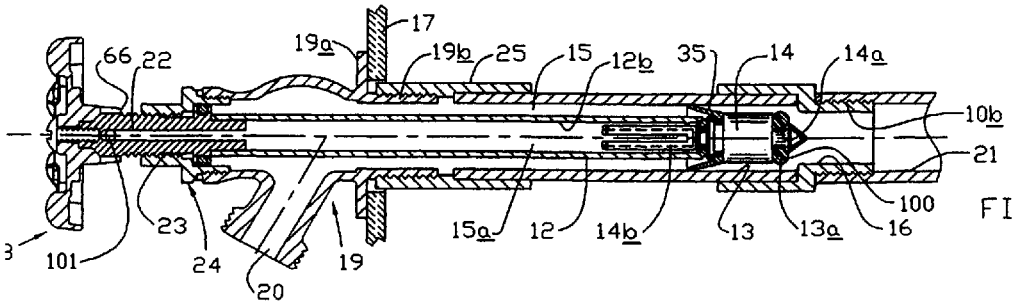
FIG. 2 is like FIG. 1, but shows the structure in flow "ON" or unblocked position.

In FIGS. 1 and 2, an outer tubular member 10, typically consists of metal or synthetic resinous or plastic material, and includes interfitting sub-members 10*a* and 10*b*. A first flow port 11 is provided and is typically cylindrical. An inner tubular member 12 is also provided to extend coaxially with 10, as respects longitudinal axis 12*a*. Member 12 also and typically may consist of metal or plastic material. An annular check member 35 permits fluid flow towards outlet tubing 20 and blocks fluid flow into port 11. Closure means 13, at the end of 12, serves to close port 11 in relatively axially advanced position of the closure means 13, as shown in FIG. 1; and to open port 11 in relatively axially retracted position of the means 13 as shown in FIG. 2. The closure means 13 typically includes an elastomeric O-ring 13*a* fitting about stem 14*a* of a plug or "bullet" body 14, there being a body extension or stem 14*b* projecting rearwardly into the member 12 for carriage by the latter.

When a control means, such as valve handle 18 is rotated in one direction, for example counter-clockwise, the sealing O-ring 13*a* backs away, i.e. leftwardly, from the bore 16, as in FIG. 2, allowing pressurized water to flow leftwardly from inlet tubing 21 past the element 14 and the O-ring, defining a flow port 100 to flow to the outlet tubing at 20 carried by body 19, as for delivery from a building or residence. A residence wall is indicated at 17, in FIG. 2, and engaged by body flange 19*a*. When handle 18 is rotated clockwise, inner member 12 moves rightwardly to advance closure means 13 to FIG. 1 "OFF" position.

Handle 18 has connection to a threaded metallic tube 22 that carries the leftward end of inner tubing 12. Tube 22 has threaded connection at 23 to a fitting 24, that in turn connects to the body 19. The rightward end of body part 19*b* carries the outer tubular metallic or extruded plastic member 10, as shown by coupling 25. An external stop shoulder 26 on fitting 24 limits rightward travel of the rotated handle, tube 22 and inner tubing 12, in FIG. 1 position; and an internal stop shoulder 27 on the fitting 24 limits leftward travel of 22 and 12 in response to opposite direction rotated travel of the handle and tubing 12, in FIG. 2. An abutment 30 on tube 22 engages shoulder 27. Note that tube 12 is rotated by the handle, to rotate seal 13*a*, as it advances or retreats in bore 11, to said sealing formation.

Figure 3:
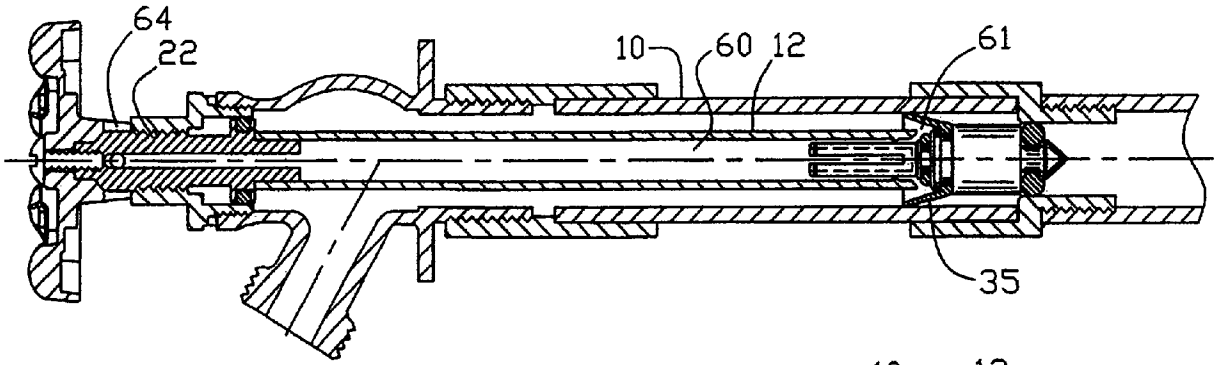
FIG. 3 is like FIG. 1 where hydrant structure is in "off" position and starting to freeze, the section showing water pressure release through the bore of the inner tubular member.
Figure 4:
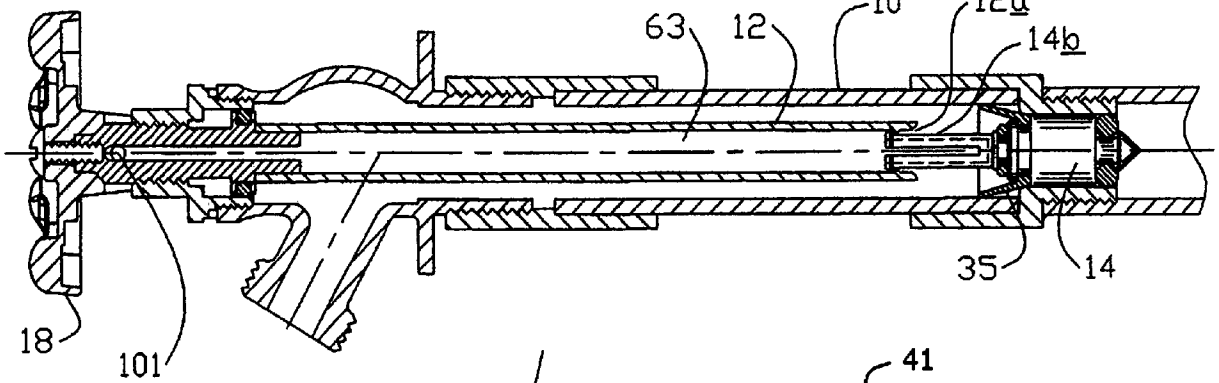
FIG. 4 is like FIG. 3 but showing sealing position of a relatively slidable sealing element when the hydrant is fully frozen.

Element 14 typically may consist of metal, and is carried to move forwardly under increased pressure exerted by forwardly expanding freezing hydraulic fluid in annular space 15 between 10 and 12, as in closed FIG. 3 and FIG. 4 position of the valve. At that time, O-ring 13*a* slidably seals against bore 16 of plastic tubular part 10*b*. Since that seal is a sliding seal, any pressure from expanding frozen water in fluid space 15 that exceeds supply pressure, normally about 60 psi, will forwardly expand element 14 such that the pressure in fluid space 15 never exceeds the supply pressure As shown in FIG. 3, a second fluid port, i.e. a side port, as for example at 101, in tube 22, is located sidewardly of the inner tubular member to pass escape fluid in relatively advanced position of the inner member to redundantly relieve fluid pressure in space 15 within 12, the inner member being elongated and extending lengthwise in said outer tubular member. Relief of pressure that might damage the hydrant, in the first instance is provided by rightward expansion or travel of plug or bullet 14 and seal 13*a*, in the bore of 11. Fluid in space 15 accesses space 15*a* via clearances between stem 14*b* and bullet 14, and between 14*b* and the bore 12*b* of member 12, when bullet 14 moves forwardly to disengage the end of 12.

FIGS. 3 and 4 are similar to FIGS. 1 and 2, but show pressurized fluid flow into the interior 60 of inner tubular member 12, via a gap 61 between the end 12*a* of member 12 and the stem 14*b*. Such fluid can escape to the exterior via axial passage 63 within member 12, and a radial outlet 101 in tube 22, proximate handle 18.

Figure 5:
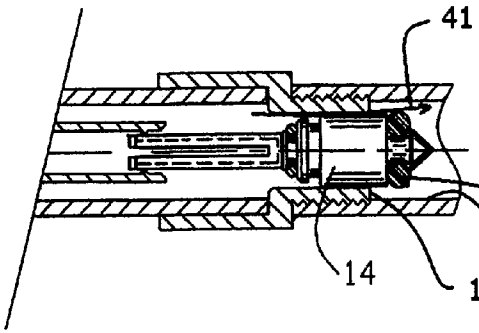
FIG. 5 is a fragmented section showing modified elements in advanced position of the slidable sealing element.

FIG. 5 shows a modification for further pressurized fluid flow 41 into inlet tubing 21 when O-ring 13*a* moves past shoulder 11*b* of bore 11.

Of importance, as an added feature of the invention, is the ability to mold the left end portion of plastic member 10 into position in metallic tubular connector 25, or equivalent metallic support structure, for example 19*b*, to simplify and reduce cost of fabrication yet strengthen the hydrant on the exterior of the outside wall.

In the above, since the inner tubular member 12 is not compressing a rubber washer as with a conventional sealing means, and the outer tubular member never sees pressure beyond the supply pressure, both the inner and outer tubular members may consist of extruded plastic material, or of metal.

What is claimed is:

1. In a hydrant assembly, the combination comprising a) an outer tubular member having a first flow port, b) an inner tubular member having closure means thereon to close said port in relatively axially advanced position of said closure means, and to open said port in relatively axially retracted position of said closure means that allows fluid flow through said port to an outlet from said outer tubular member, c) control means to control relative movement of the inner and outer members, d) said closure means comprising an annular first seal extending about an axis defined by said closure member, there being an axially elongated bore carried by said outer member, and into which said first seal has sliding sealing fit as the closure means is advanced beyond advanced position of said inner tubular member, and wherein the closure means remains slidable in said primary bore in spacially advanced positions of the first seal relative to said primary bore, and e) there being a stem projecting from said closure means for slidable reception into the forward end of said inner tubular member.

2. The combination of claim 1 including a second port located sidewardly of the outer member to pass fluid from space between the members, to relieve fluid pressure build-up under freeze conditions.

3. The combination of claim 1 including a hollow valve body carrying said members, and an adjustment handle carried by said body to adjust said inner member between relatively endwise advanced and retracted positions.

4. The combination of claim 3 wherein said members are longitudinally elongated, and said handle is located remotely from said closure means.

5. The combination of claim 3 wherein said members are endwise elongated, and the outer member consists of plastic material and extends endwise between the handle and said port.

6. The combination of claim 1 wherein major length of the inner member consists of plastic material.

7. The combination of claim 6 wherein said hollow valve body is metallic and endwise supports said plastic tubular member.

8. The combination of claim 7 wherein said closure means includes a sealing plug carried by said inner tubular member to seal off against a bore carried by the outer tubular member during establishing of said sliding sealing fit.

9. The combination of claim 8 wherein the closure means has an extended position in which said seal is everywhere forwardly spaced from and outside said bore, said closure means including a bullet having a forward face, said seal being an O-ring and everywhere projecting forwardly of said forward most face of said bullet.

10. The combination of claim 1 including a stem projecting from said closure member for slidable reception into the forward end of said inner member.

11. The combination of claim 1 wherein an O-ring seal is captivated between axially spaced flanges carried by said stem for axial movement between said flanges.

* * * * *